US006718737B2

(12) United States Patent
Otsuka et al.

(10) Patent No.: US 6,718,737 B2
(45) Date of Patent: Apr. 13, 2004

(54) METHOD OF AND APPARATUS FOR AUTOMATICALLY PACKAGING ENCASED PRODUCT

(75) Inventors: Takao Otsuka, Minamiashigara (JP); Sakae Kagawa, Minamiashigara (JP); Rie Aoki, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 70 days.

(21) Appl. No.: 10/006,121

(22) Filed: Dec. 10, 2001

(65) Prior Publication Data

US 2002/0069618 A1 Jun. 13, 2002

(30) Foreign Application Priority Data

Dec. 12, 2000 (JP) ..... 2000-377589

(51) Int. Cl.[7] ..... B65B 35/58

(52) U.S. Cl. ..... 53/449; 33/557; 33/434; 33/430; 33/543; 198/402; 198/403; 198/404

(58) Field of Search ..... 33/557, 449, 434, 33/430, 543; 198/402, 403, 404

(56) References Cited

U.S. PATENT DOCUMENTS 3,166,878 A * 1/1965 Pepitone et al. ..... 53/442
4,771,589 A * 9/1988 Mueller et al. ..... 53/448
5,797,247 A * 8/1998 Nakagoshi et al. ..... 53/557
6,003,287 A * 12/1999 Ballestrazzi et al. ..... 53/557

* cited by examiner

*Primary Examiner*—Rinaldi I. Rada
*Assistant Examiner*—Michelle Lopez
(74) *Attorney, Agent, or Firm*—Sughrue Mion, PLLC

(57) ABSTRACT

An automatic packaging apparatus has an arraying and supplying station, a sorting station and a packaging station. The arraying and supplying station forcibly arrays and supplies encased products to orient their caps in one direction. The sorting station selectively sorts the arrayed encased products to a first feed path for feeding the encased products to package the encased products in a abreast-arrayed attitude and a second feed path for feeding the encased products to package the encased products in a tandem-arrayed attitude. The packaging station automatically packages the encased products by a shrink sheet in the abreast-arrayed attitude or the tandem-arrayed attitude.

7 Claims, 15 Drawing Sheets

METHOD OF AND APPARATUS FOR AUTOMATICALLY PACKAGING ENCASED PRODUCT

BACKGROUND OF THE INVENTION

1. Field of the Invention

The present invention relates to a method of and an apparatus for automatically packaging a given number of encased products, each comprising a product sealed in a case barrel and a cap mounted on the case barrel, in a packaging sheet.

2. Description of the Related Art

It has been commonly practiced in the packaging industry to obtain an encased product by loading a product, such as a cartridge housing a rolled photographic photosensitive film, into a film case of synthetic resin, shrink-package a given number of encased products together into a shrink package, and cover the shrink package with an outer pack, thus producing a pillow-type packaged product.

Packaged products are available in a variety of forms. According to one form, a packaged product contains a single encased product. According to another form, a packaged product as a box packages a plurality of encased products therein, ranging from two to thirty encased products. According to still another form, two through five encased products are put together and placed in an outer pack, which will be hereinafter referred to as "assembly packaged product".

There are two types of assembly packaged products known in the art. According to one type, two through five encased products are sealed together in an outer pack while they are being arrayed with the case caps on the film cases being oriented in a direction across the direction in which the encased products are fed, i.e., while they are being arrayed abreast or side by side. According to the other type, two through three encased products are sealed together in an outer pack while they are being arrayed with the case caps being oriented in the direction in which the encased products are fed, i.e., while they are being arrayed in tandem or end to end.

Specifically, as shown in FIG. 15 of the accompanying drawings, a cartridge (product) 2 housing a rolled photographic photosensitive film is loaded into a film case (case barrel) 3, and a case cap 4 is attached to an open end of the film case 3, thus producing an encased product 5.

Then, a plurality of, e.g., two, encased products 5 are arranged in tandem or end to end, and shrink-packaged by a shrink sheet (packaging sheet) 6*b*, producing a tandem-arrayed shrink-packaged product 7*b*. Alternatively, four encased products 5, for example, are arrayed abreast or side by side, and shrink-packaged by a shrink sheet (packaging sheet) 6*a*, producing an abreast-arrayed shrink-packaged product 7*a*. The tandem-arrayed shrink-packaged product 7*b* and the abreast-arrayed shrink-packaged product 7*a* are sealed respectively in outer packs 8*b*, 8*a*, producing packed products 9*b*, 9*b*.

Conventional packaging apparatus are only designed to automatically package the abreast-arrayed shrink-packaged product 7*a*. It has been customary in the art to manually package the tandem-arrayed shrink-packaged product 7*b* in the outer pack 8*b*. Therefore, the conventional packaging apparatus fail to efficiently meet requirements for the selective production of the abreast-arrayed shrink-packaged product 7*a* and the tandem-arrayed shrink-packaged product 7*b*, and are poor in applicability in the manufacture of differently packaged products.

SUMMARY OF THE INVENTION

It is a major object of the present invention to provide a method of and an apparatus for automatically and efficiently packaging differently oriented encased products with a simple process and arrangement.

In a method of and an apparatus for automatically packaging a given number of encased products according to the present invention, the encased products are forcibly arrayed to have their caps oriented in one direction, and then sorted selectively to a first feed path and a second feed path depending on the packaging pattern for the encased products. On the first feed path, the encased products are fed in a first attitude. On the second feed path, the encased products are fed in a second attitude which is different from the first attitude.

The encased products arrayed in the first attitude by the first feed path or the encased products arrayed in the second attitude by the second feed path are packaged by a packaging sheet. Therefore, a certain number of encased products can selectively and automatically be packaged in one of the different first and second attitudes. The apparatus is therefore highly flexible in applications, and is much more economic than if dedicated machines are used to package the encased products in the first and second attitudes.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
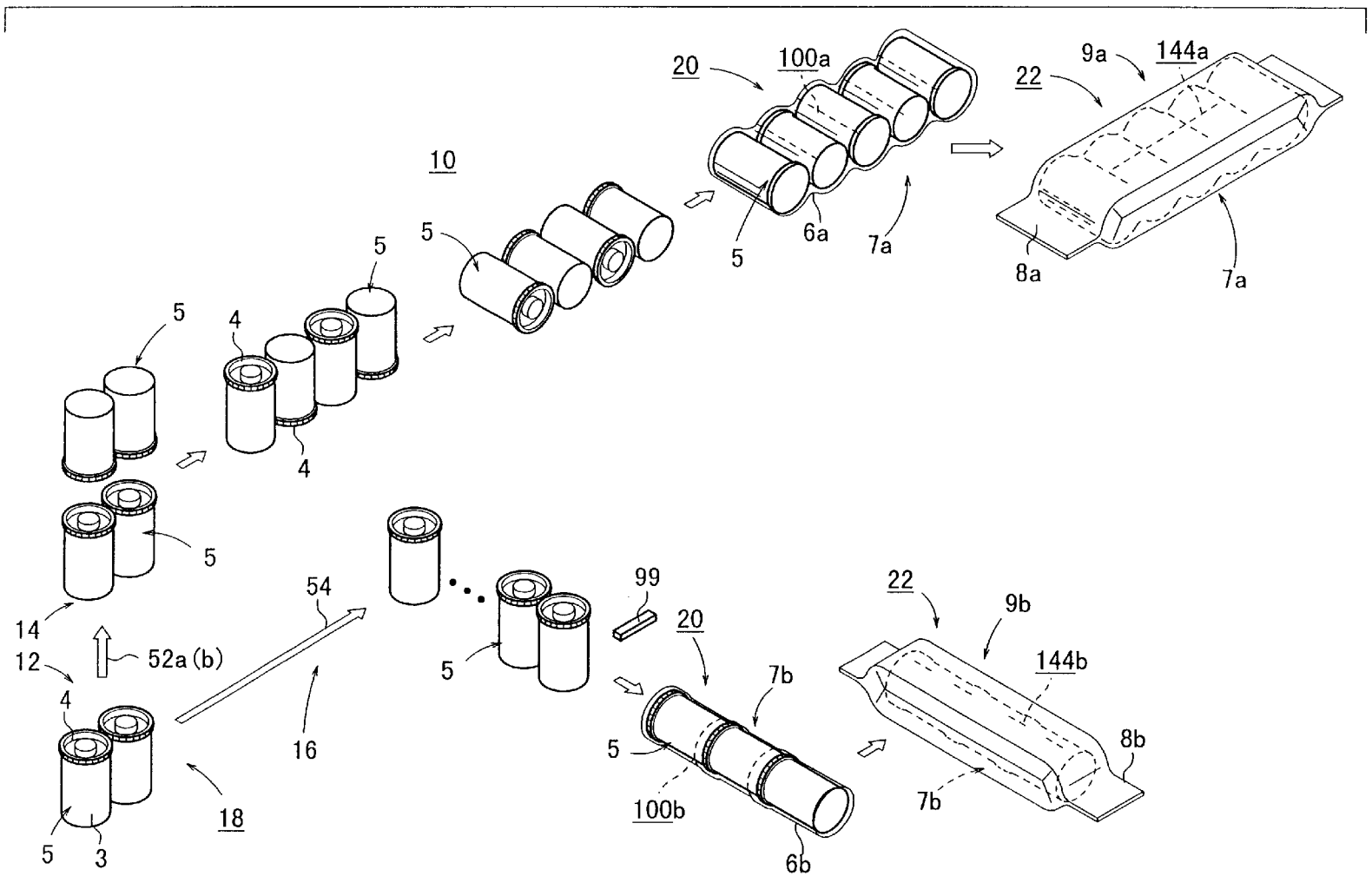
FIG. 1 is a schematic perspective view illustrative of a method of automatically packaging encased products according to the present invention.
Figure 2:
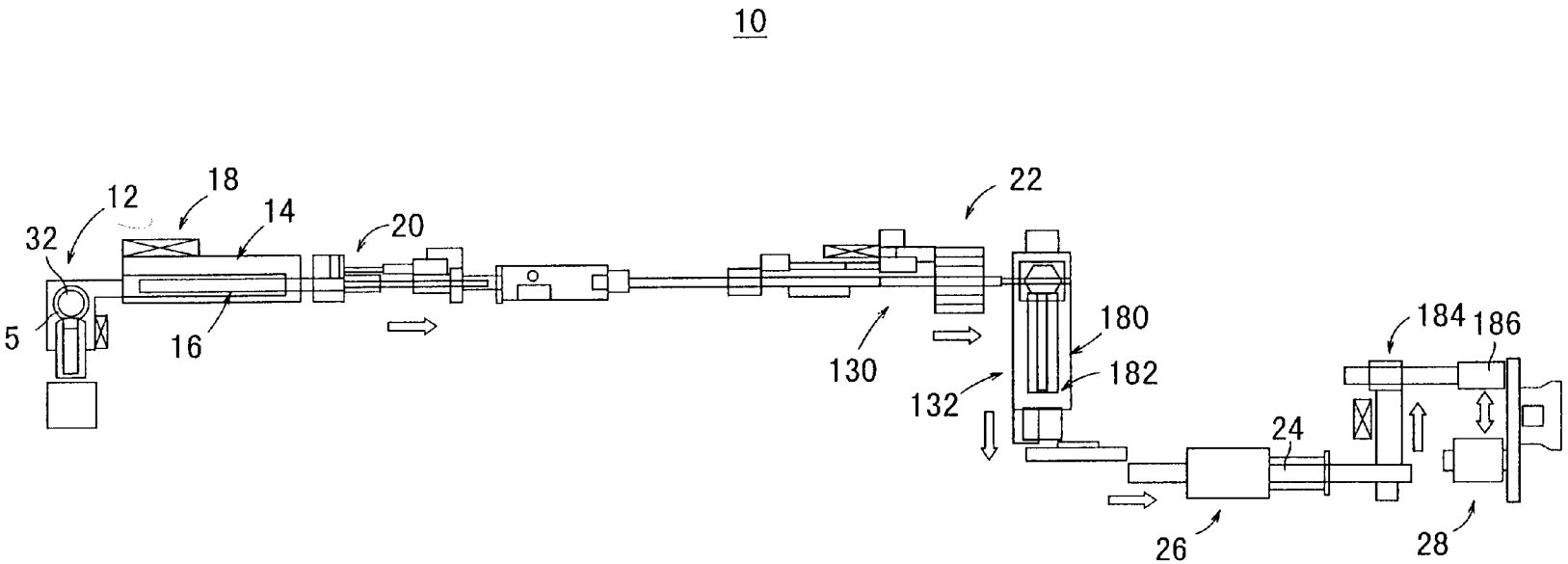
FIG. 2 is a schematic plan view of an automatic packaging apparatus for carrying out the method of automatically packaging encased products.

FIG. 1 illustrates a method of automatically packaging encased products according to the present invention, and FIG. 2 shows in plan an automatic packaging apparatus 10 for carrying out the method of automatically packaging encased products.

As shown in FIGS. 1 and 2, the automatic packaging apparatus 10 comprises an arraying and supplying station 12 for forcibly arraying and supplying encased products 5 with case caps 4 directed in one direction, e.g., upwardly; a sorting station 18 for selectively sorting encased products 5 into a first feed path 14 for arraying encased products 5 to package them in a first attitude or orientation and a second feed path 16 for arraying encased products 5 to package them in a second attitude or orientation which is different from the first attitude or orientation; a packaging station 20 for packaging a given number of encased products 5, which have been arrayed in the first attitude by the first feed path 14 or a given number of encased products 5 which have been arrayed in the second attitude by the second feed path 16, with shrink sheets (packaging sheets) 6*a*, 6*b*; a packing station (packaging station) 22 for sealing an abreast-arrayed shrink-packaged product 7*a* and a tandem-arrayed shrink-packaged product 7*b* respectively in outer packs 8*a*, 8*b*, producing packed products 9*a*, 9*b*; a corrugated case packing station 26 for placing a given number of packed products 9*a*, 9*b* in a corrugated cardboard case 24; and a palletizing station 28 for stacking a number of corrugated cardboard cases 24.

Figure 3:
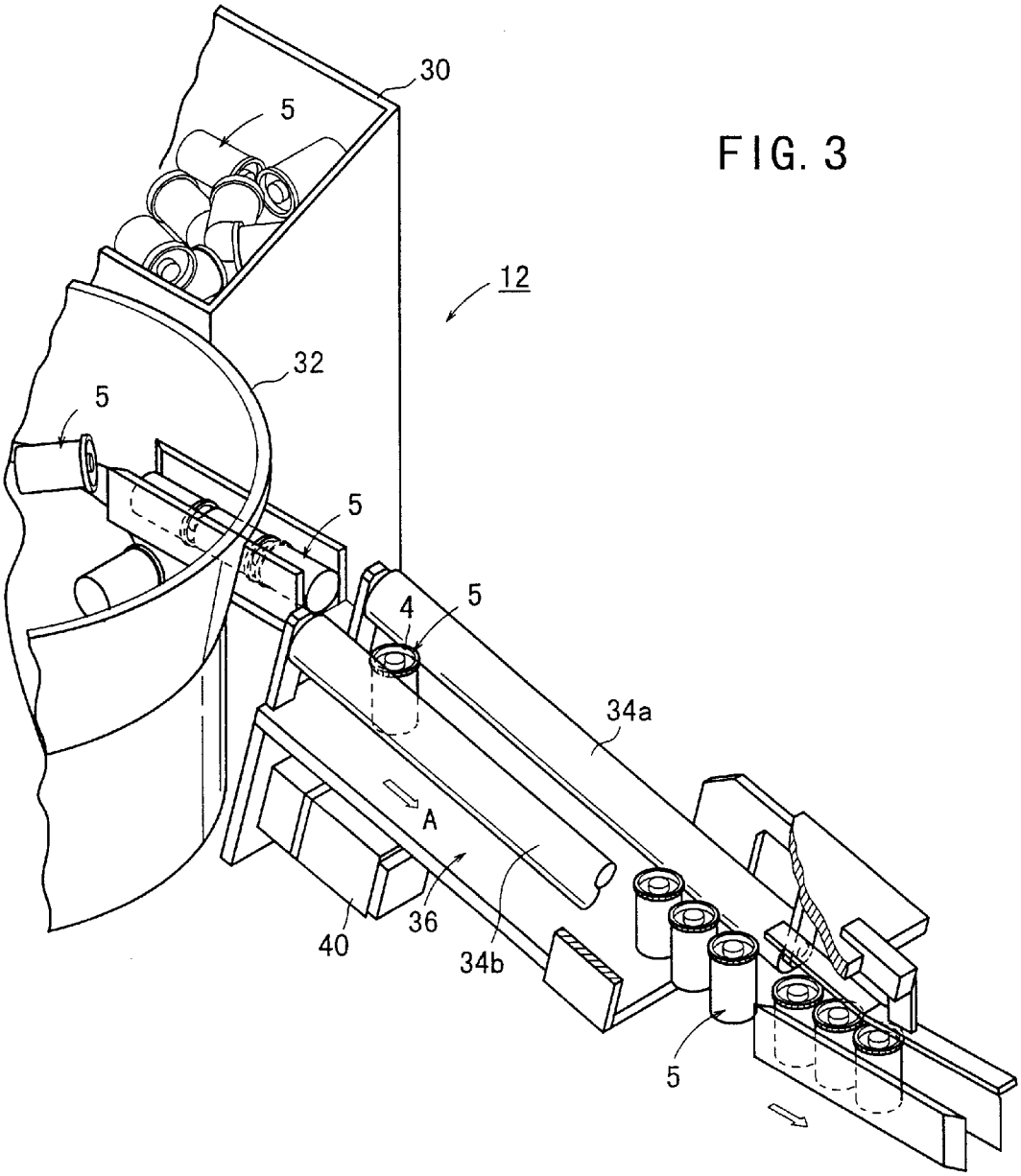
FIG. 3 is a fragmentary perspective view of an arraying and supplying station of the automatic packaging apparatus.

As shown in FIG. 3, the arraying and supplying station 12 comprises a container 30 for containing a number of encased products 5, a feeder 32 for successively feeding encased products 5 from the container 30, and a pair of rollers 34*a*, 34*b* for supporting the case caps 4 of encased products 5 delivered from the feeder 32 and feeding the encased products 5 with the case caps 4 oriented upwardly in the direction indicated by the arrow A. The feeder 32 has an inclined feed surface 36 for supplying encased products 5 therealong to the rollers 34*a*, 34*b* with the case caps 4 facing forward or backward.

Figure 4:
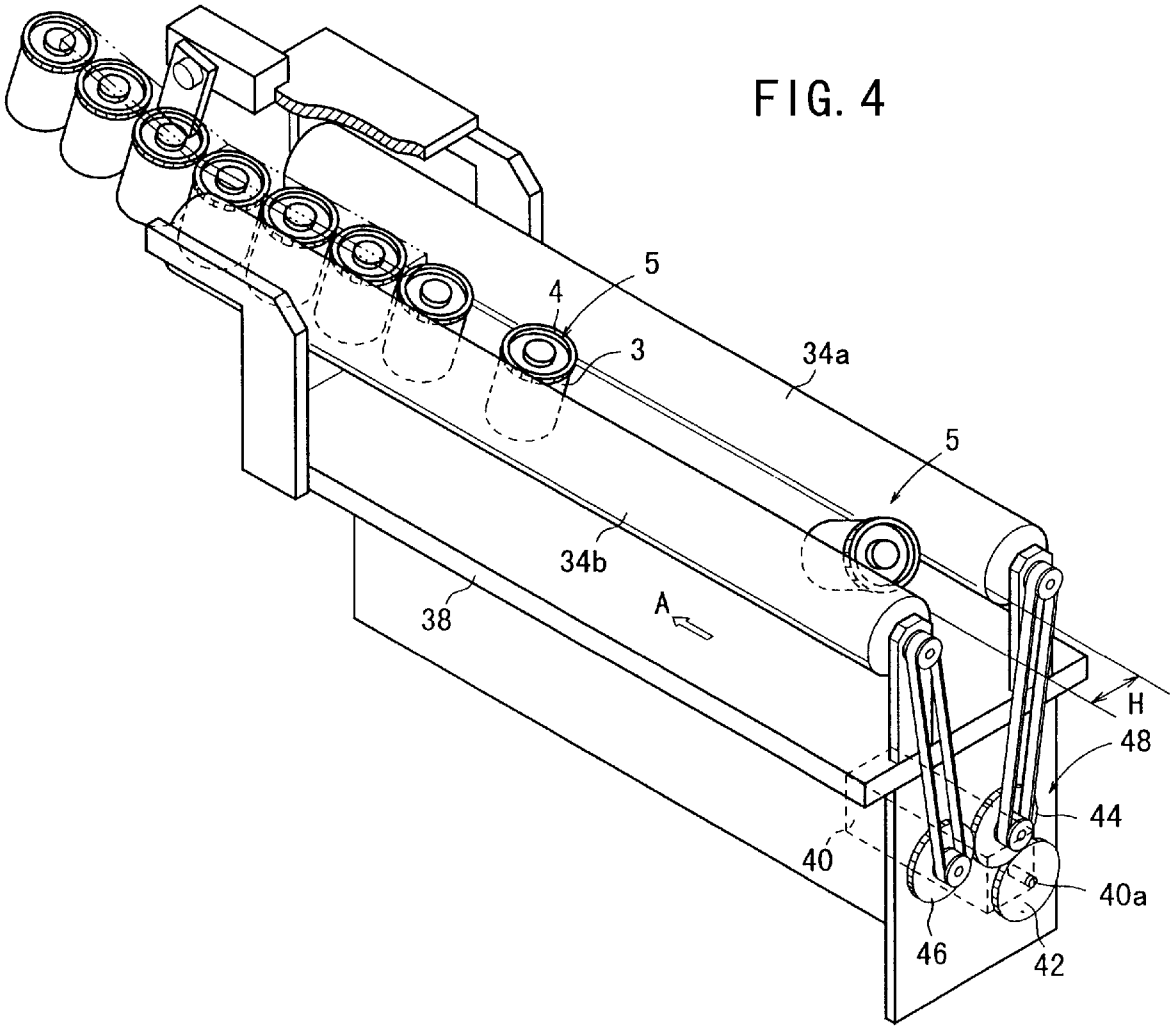
FIG. 4 is a perspective view of rollers of the arraying and supplying station.

As shown in FIG. 4, the rollers 34*a*, 34*b* are rotatably supported at their opposite ends on a frame 38. The rollers 34*a*, 34*b* have respective outer circumferential surfaces spaced from each other by a minimum distance H which is greater than the diameter of the film cases 3 of encased products 5 and smaller than the diameter of the case caps 4 thereof. A motor 40 is mounted on an end wall of the frame 38 and has a drive shaft 40*a* to which a drive gear 42 is fixed. The drive gear 42 is held in mesh with a first gear 44 which is held in mesh with a second gear 46. The rollers 34*a*, 34*b* have respective ends operatively coupled to the first and second gears 44, 46 by belt-and-pulley means 48.

Figure 5:
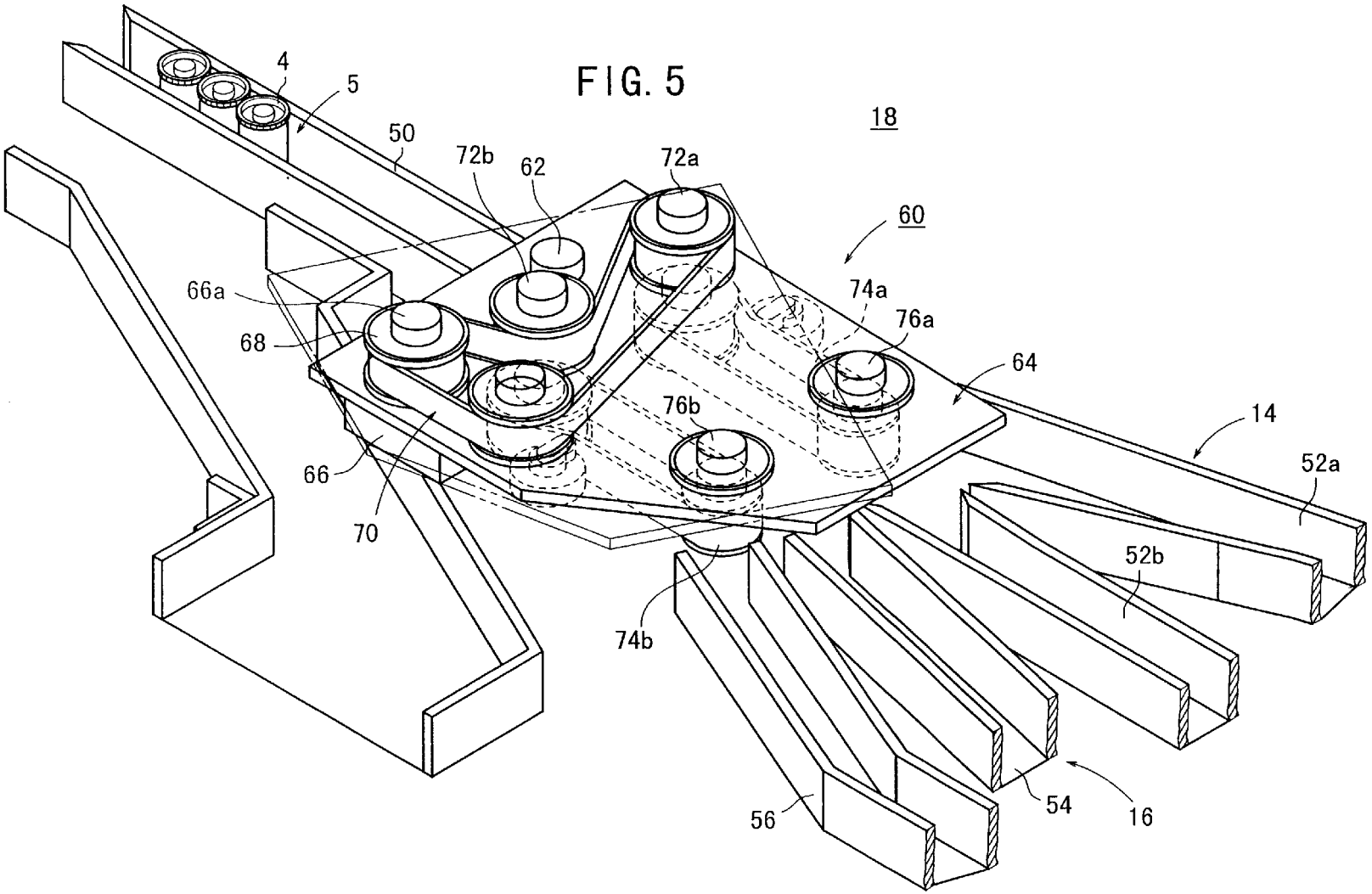
FIG. 5 is a perspective view of a sorting station of the automatic packaging apparatus.
Figure 6:
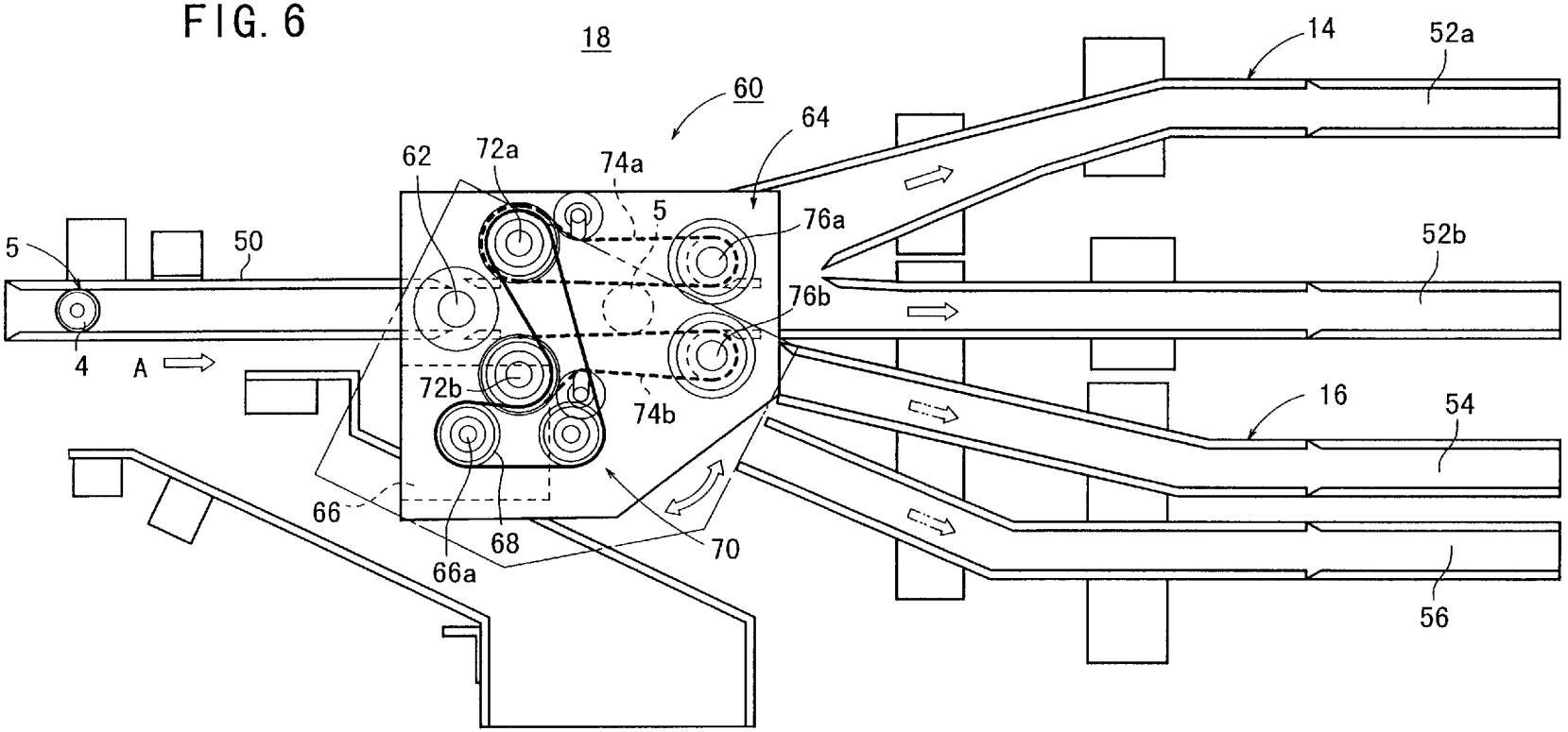
FIG. 6 is a plan view of the sorting station.

As shown in FIGS. 5 and 6, the sorting station 18 has a sorting device 60 disposed at a terminal end of a guide channel 50 for feeding encased products 5, in an upright orientation, in the direction of the arrow A with their case caps 4 directed upwardly. The sorting device 60 serves to selectively supply encased products 5 to first conveyor lines 52*a*, 52*b* which make up the first feed path 14, a second conveyor line 54 which makes up the second feed path 16, and a third conveyor line 56 for feeding defective products, which are devoid of case caps 4.

The sorting device 60 has a rotary base 64 angularly movable about a pivot shaft 62 selectively to different angular positions. A motor 66 is fixedly mounted on the lower bottom surface of the rotary base 64 and has an upwardly projecting drive shaft 66*a* to which a drive pulley 68 is secured. The drive pulley 68 is operatively coupled to first rotatable shafts 72*a*, 72*b* by belt-and-pulley means 70. The first rotatable shafts 72*a*, 72*b* are operatively coupled to respective second rotatable shafts 76*a*, 76*b* by respective feed belts 74*a*, 74*b* which are movable in a circulatory path in contact with the outer circumferential surfaces of encased products 5.

Figure 7:
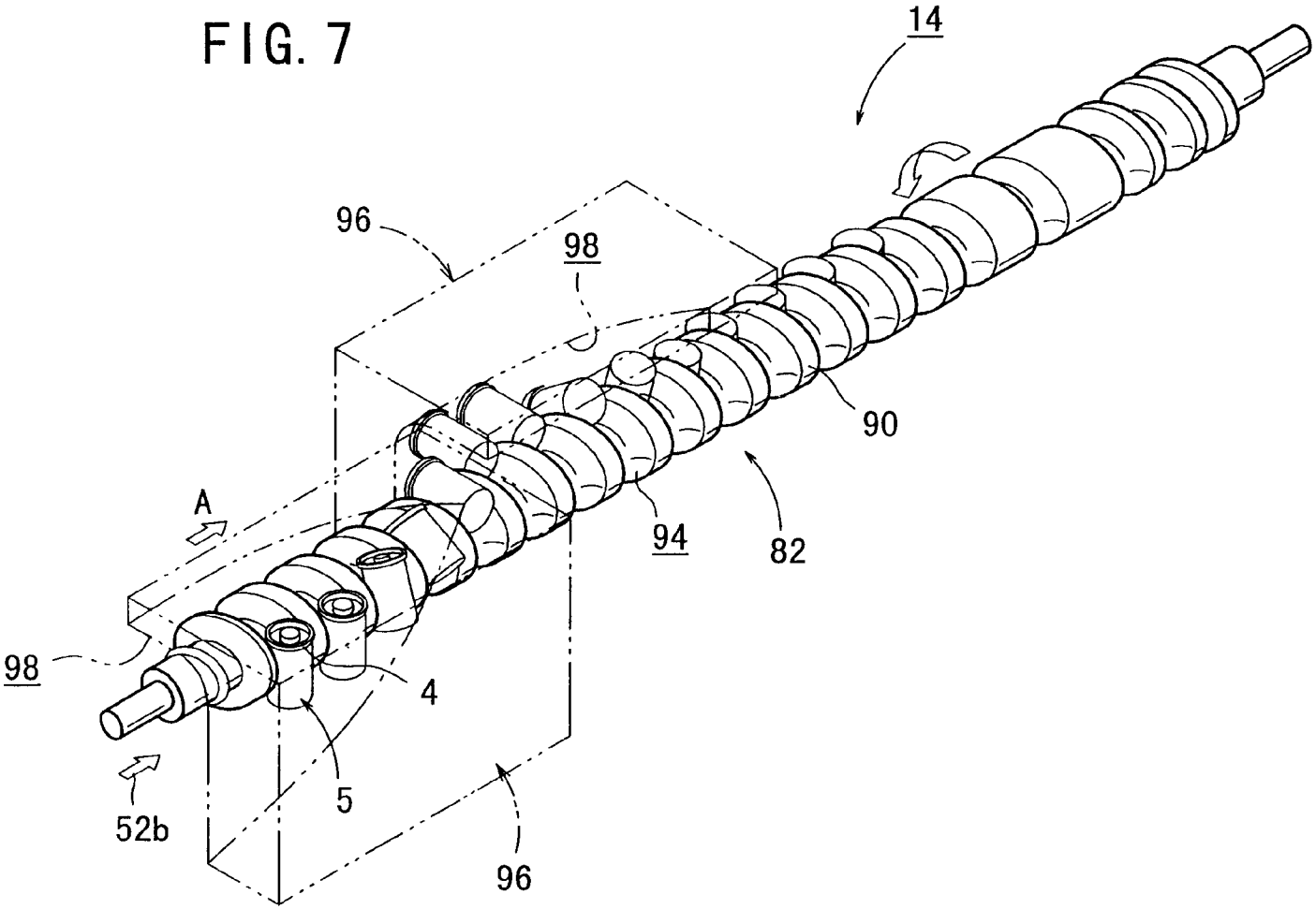
FIG. 7 is a partial perspective view of a portion of a first feed path of the sorting station.
Figure 8:
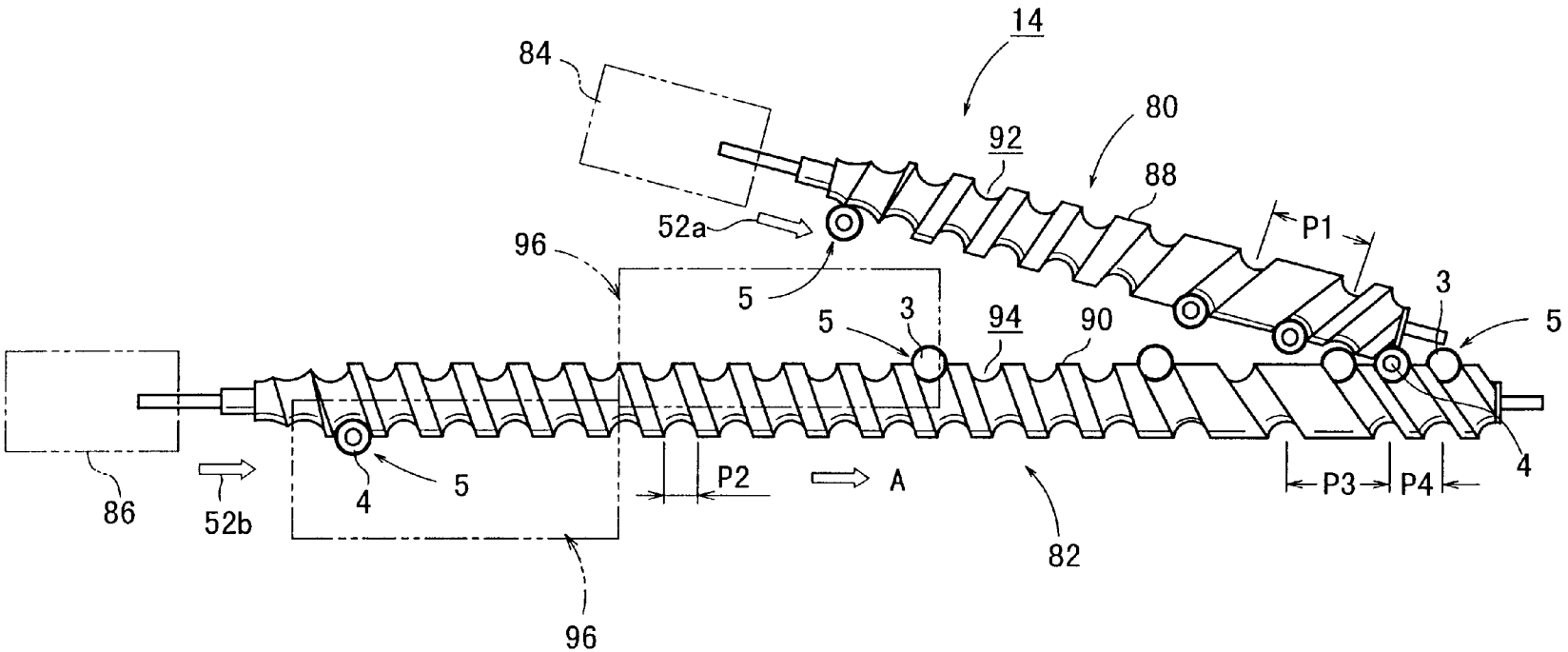
FIG. 8 is a plan view of the first feed path.

As shown in FIGS. 7 and 8, a first delivery unit 80 for feeding encased products 5 with the case caps 4 oriented upwardly is disposed at the distal end of the first conveyor line 52*a* of the first feed path 14. A second delivery unit 82 for reversing encased products 5 to orient the case caps 4 downwardly and thereafter discharging the reversed encased products 5 alternately with the encased products from the first delivery unit 80 is disposed at the distal end of the second conveyor line 52*b* of the first feed path 14.

The first and second delivery units 80, 82 have respective first and second screws 88, 90 rotatable about their axes by respective motors 84, 86. The first screw 88 is inclined from the distal end of the first conveyor line 52*a* toward the second delivery unit 82. The first screw 88 supports the case caps 4 mounted on encased products 5 with the inner wall surface of a spiral groove 92 defined in the outer circumferential surface of the first screw 88, and feeds the encased products 5 toward the second delivery unit 82 upon rotation of the first screw 88 about its own axis. The spiral groove 92 in the distal end portion of the first screw 88 has a pitch P1 set to an interval large enough to place another encased product 5 between two adjacent encased products 5 held by the groove 92.

The second screw 90 has a spiral groove 94 defined in the outer circumferential surface thereof. The spiral groove 94 has a pitch P2 over a given length from the upstream end of the second screw 90 in its feed direction, a pitch P3 following the pitch P2 for spacing reversed encased products 5 from each other, and a pitch P4 following the pitch P3 for alternately arranging reversed encased products 5 and encased products 5 from the first delivery unit 80 at given spaced intervals.

A pair of guides 96 are disposed such that one is on each side of an upstream portion of the second screw 90 and spaced from each other transversely and longitudinally of the second screw 90. The guides 96 have guide grooves 98 defined in their surfaces facing the second screw 90. The guide grooves 98 serve to reverse encased products 5 supported by the second screw 90 through 180° to orient the case caps 4 downwardly upon rotation of the second screw 90.

The second conveyor line 54 of the second feed path 16 feeds encased products 5 in the direction indicated by the arrow A with the case caps 4 oriented upwardly. As shown in FIG. 1, the encased products 5 while they are being fed by the second conveyor line 54 are knocked down backward in the feed direction by a knock-down member 99 shown in FIG. 1. The encased products 5 are fed with their case caps 4 positioned behind in the direction indicated by the arrow A.

The packaging station 20 is supplied with rolled sheets having different widths for producing the shrink sheet 6*a* which shrink-packages a given number of, e.g., five, abreast-arrayed encased products 5 and the shrink sheet 6*b* which shrink-packages a given number of, e.g., three, tandem-arrayed encased products 5. The packaging station 20 seals the encased products with the shrink sheets 6*a*, 6*b* in a three-sided pillow configuration, and heat-shrinks the shrink sheets 6*a*, 6*b* in a heating tunnel. The shrink sheets 6*a*, 6*b* have perforations 100*a*, 100*b* (see FIG. 1) which are defined therein at given positions thereon before they shrink-package the encased products 5.

Figure 9:
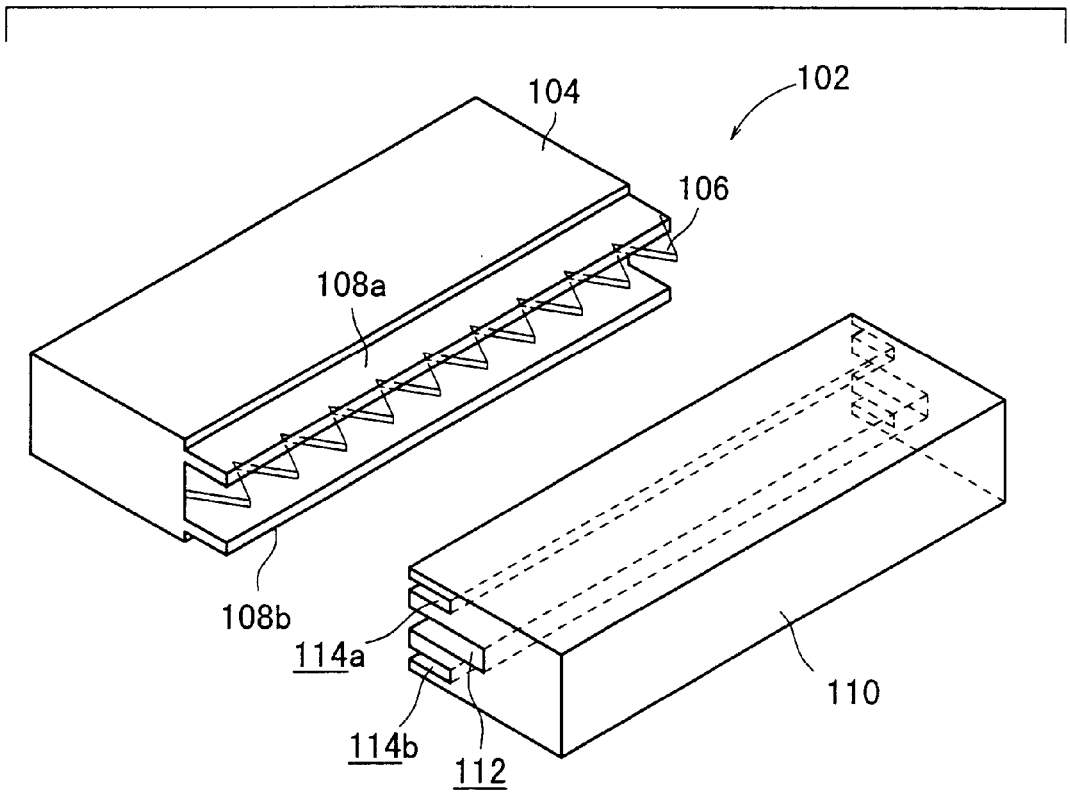
FIG. 9 is a perspective view of a cutter in a packaging station of the automatic packaging apparatus.

The shrink sheets 6*a*, 6*b* are perforated by a cutter 102 shown in FIG. 9. The cutter 102 comprises a cutter blade 106 mounted on a bracket 104 and plates 108*a*, 108*b* disposed above and below the cutter blade 106 and projecting outwardly beyond the distal end of the cutter blade 106. The cutter blade 106 has saw-toothed cutting edges spaced at given intervals. The cutter 102 also comprises a bracket 110 disposed in confronting relation to the cutter blade 106. The bracket 110 has a reception slot 112 defined therein for receiving the cutter blade 106 therein, and also has grooves 114*a*, 114*b* defined therein above and below the reception slot 112 in horizontal alignment with the respective plates 108*a*, 108*b*.

Figure 10:
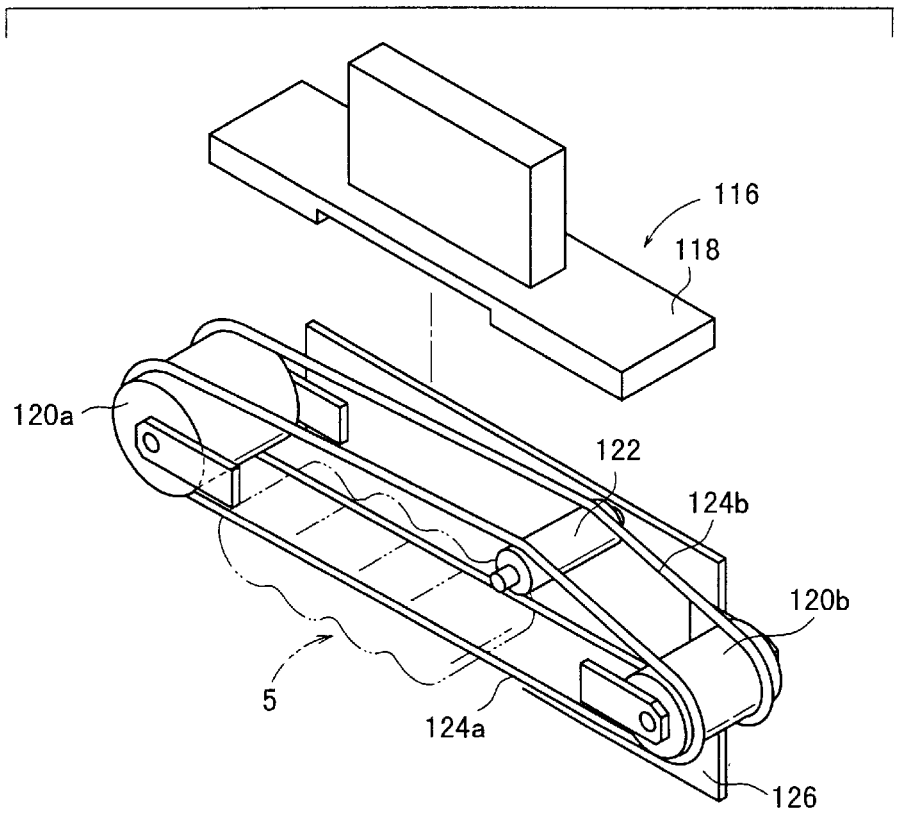
FIG. 10 is a perspective view of a presser in the packaging station.

As shown in FIG. 10, the packaging station 20 has a movable presser 116 for holding five tandem-arrayed encased products 5 together when the encased products 5 are packaged by the shrink sheet 6*a*. The presser 116 has a vertically movable support base 118 on which there are rotatably supported rollers 120*a*, 120*b* and a tension roller 122. Round belts 124*a*, 124*b* that are spaced from each other are trained under tension around the rollers 120*a*, 120*b* and the tension roller 122, and a pair of guide plates 126 are disposed such that one is on each side of the round belts 124*a*, 124*b*.

Figure 11:
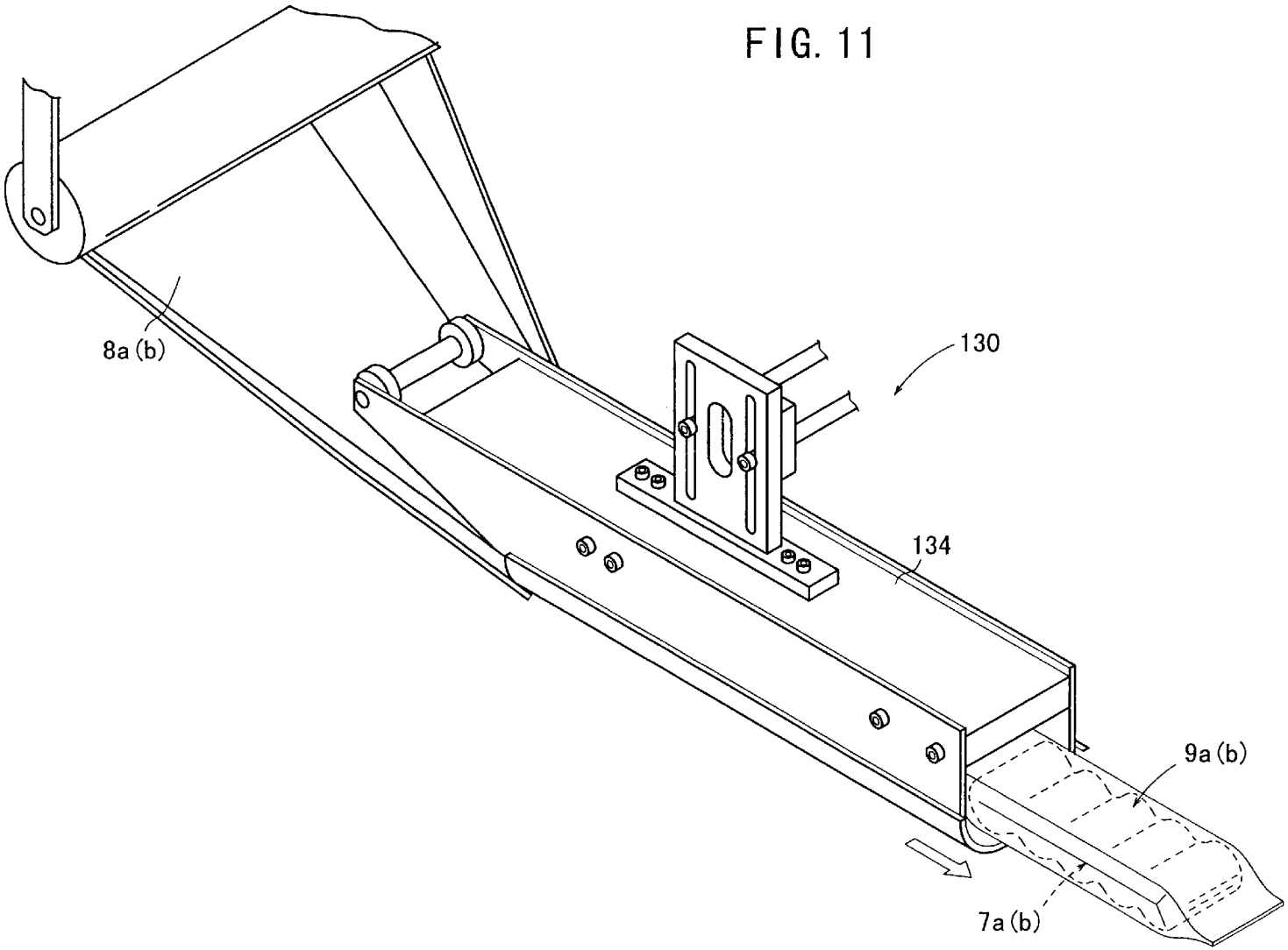
FIG. 11 is a perspective view of a pillow packaging device of the automatic packaging apparatus.

As shown in FIG. 2, the packing station 22 has a pillow packaging device (first sealing means) 130 and a tightening device (second sealing means) 132. As shown in FIG. 11, the pillow packaging device 130 has a former 134 for supplying outer packs 8*a*, 8*b* having different widths as rolled packing sheets, temporarily sealing (first seal) the outer packs 8*a*, 8*b* in a three-sided pillow configuration at front and rear ends of encased products 5, and joining transverse ends of the outer packs 8*a*, 8*b* at lower sides of the abreast-arrayed shrink-packaged product 7*a* and the tandem-arrayed shrink-packaged product 7*b*.

Figure 12:
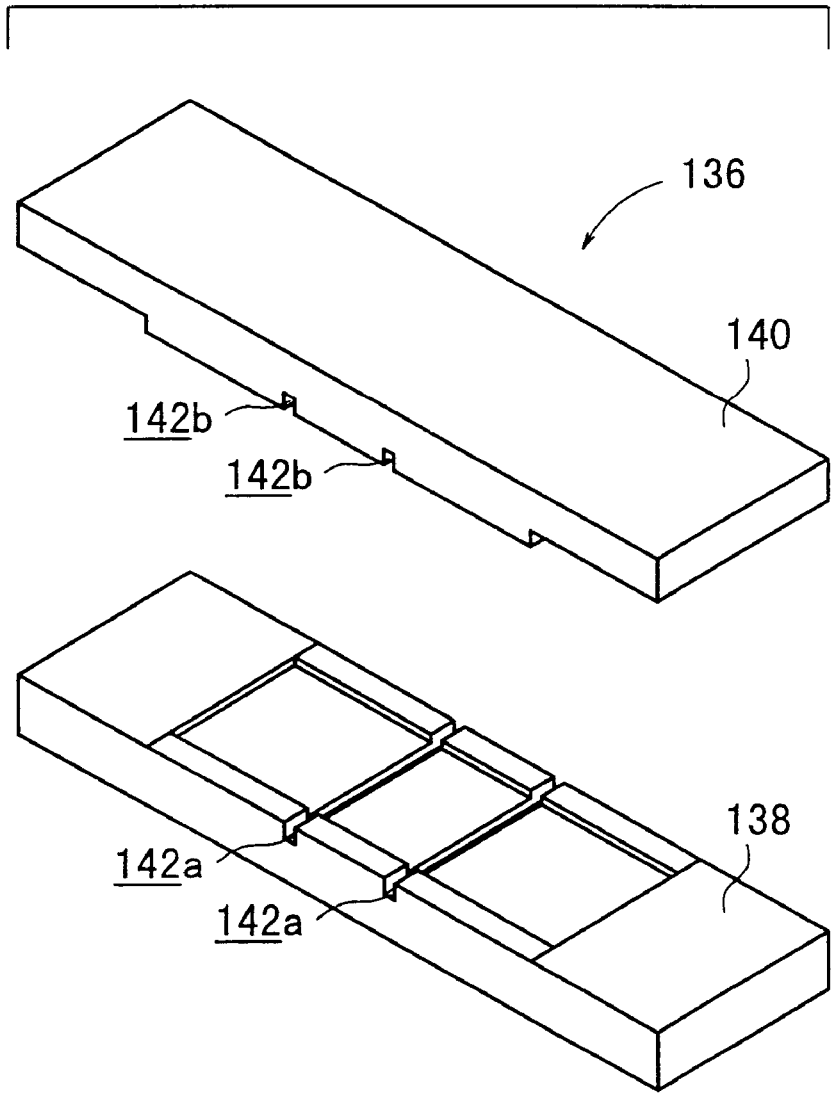
FIG. 12 is a perspective view of a heater in the pillow packaging device.

As shown in FIG. 12, the former 134 has a heater 136 comprising a lower block 138 and an upper block 140. The lower block 138 and the upper block 140 have respective sets of grooves 142*a*, 142*b* defined therein for producing unsealed regions in areas of the outer packs 8*a*, 8*b* that are temporarily sealed.

Figure 13:
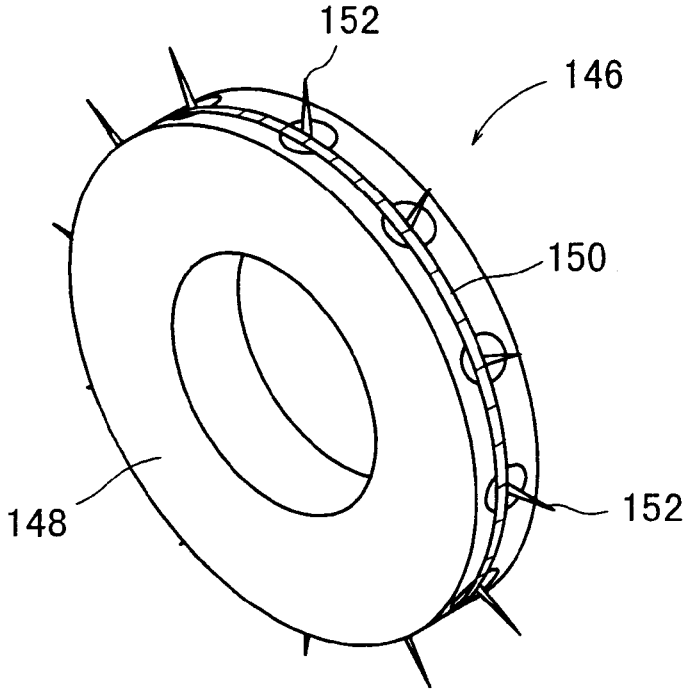
FIG. 13 is a perspective view of a perforating roller in the pillow packaging device.

The former 134 has a roller (perforating means) 146 (see FIG. 13) for forming perforations 144*a*, 144*b* (see FIG. 1) in given regions of the outer packs 8*a*, 8*b* before they are temporarily sealed, the perforations 144*a*, 144*b* being spaced at constant pitches over the entire length of the outer packs 8*a*, 8*b* in the direction in which the outer packs 8*a*, 8*b* are moved. As shown in FIG. 13, the roller 146 is positioned in the feed path of the outer packs 8*a*, 8*b* before they are pillow-packaged. The roller 146 has a roll 148 and a plurality of radially outwardly projecting needles 152 mounted on the outer circumferential surface of the roll 148 angularly spaced at equal angular intervals by a spring 150.

Figure 14:
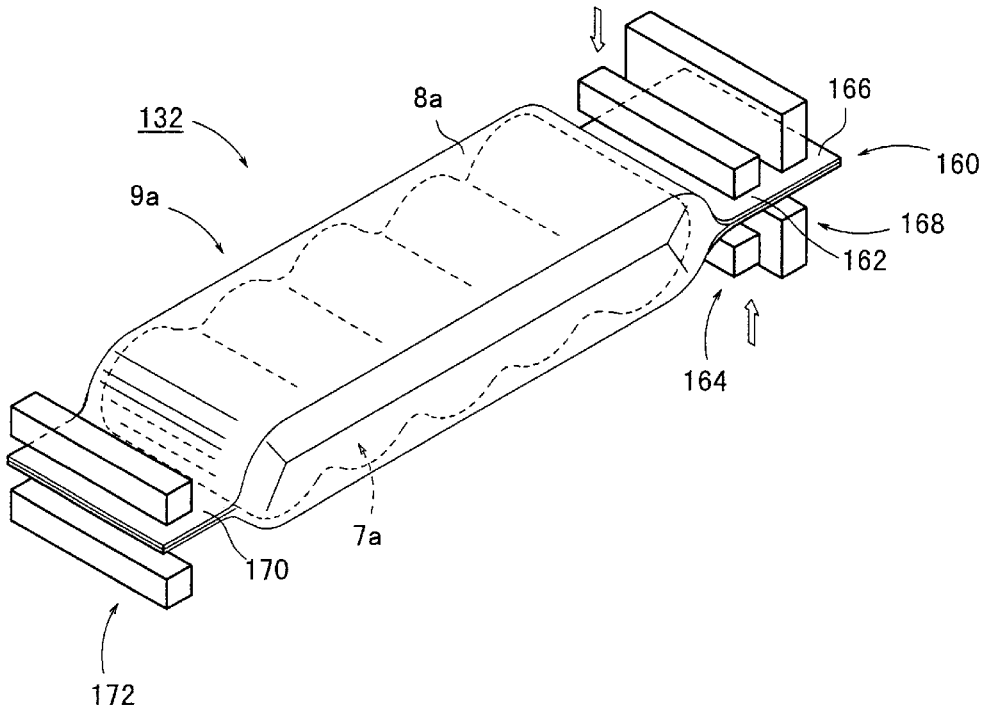
FIG. 14 is a perspective view of a tightening device of the automatic packaging apparatus.
Figure 15:
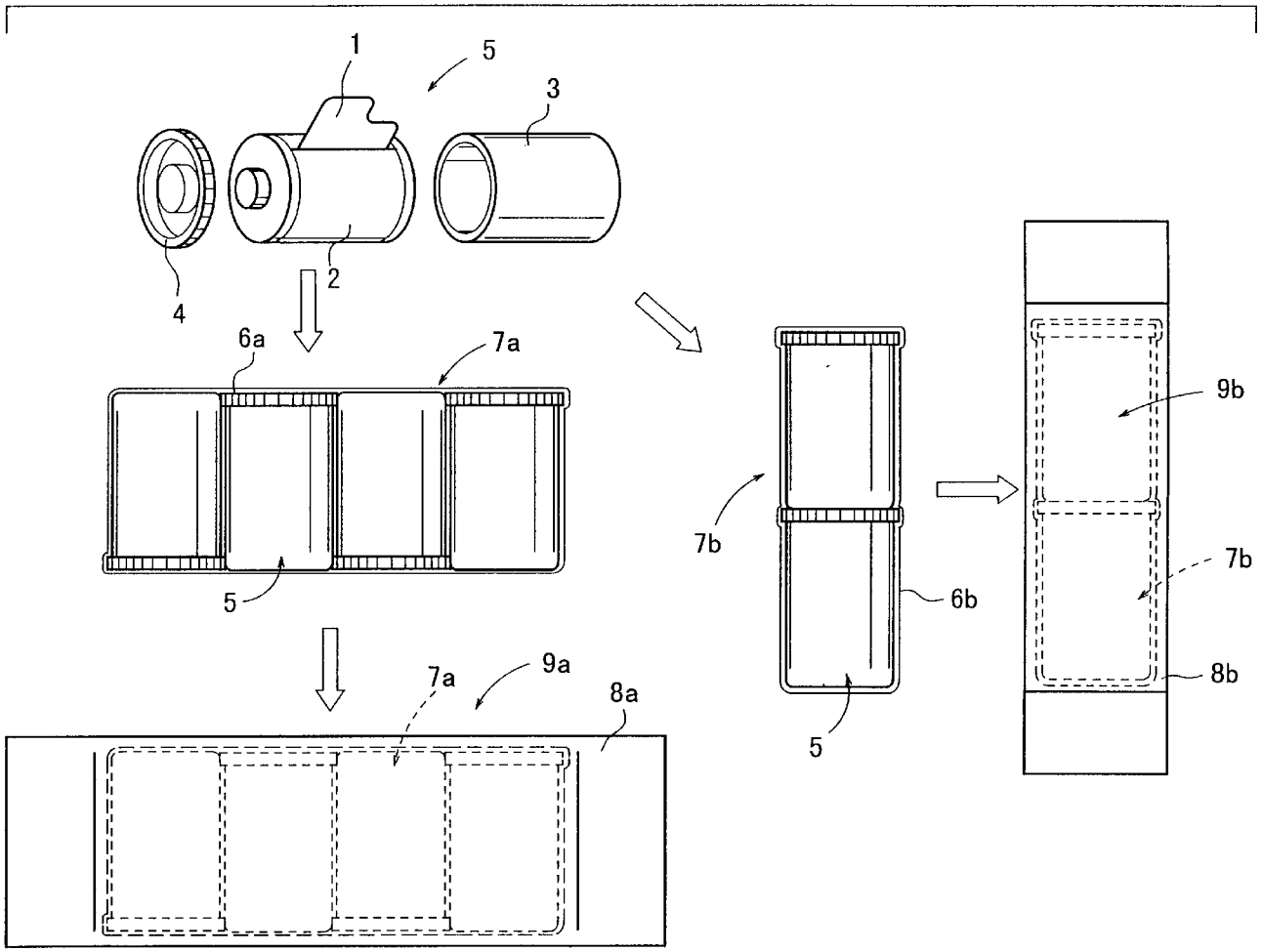
FIG. 15 is a view showing packaged patterns of encased products.

As shown in FIG. 14, the tightening device 132 has a first heater block 164 for initially pressing a first seal region 162 of the abreast-arrayed shrink-packaged product 7*a*, which serves as a hanger 160 of a packed product 9*a*; a second heater block 168 for pressing a second seal region 166 of the hanger 160, which is positioned outwardly of the first seal region 162, after the first heater block 164 presses the first seal region 162; and a third heater block 172 for pressing a third seal region 170, which serves as a shorter end of the packed product 9*a* opposite to the hanger 160. The tightening device 132 finally seals (second seal) the packed product 9*a*. An outer pack 9*b* is finally sealed by either the first through third heater blocks 164, 168, 172 or separate heater blocks (not shown).

As shown in FIG. 2, downstream of the tightening device 132, there are disposed a cooling device 180 for cooling the hanger 160 and a blanking device 182 for trimming the hanger 160 and cutting off the opposite ends of the outer pack 9*a* to produce round corners. Between the corrugated case packing station 26 and the palletizing station 28, there is disposed a printing and weight checking station 184 for printing expiration dates, emulsion numbers, and other information on the corrugated cardboard case 24 and the packed products 9*a*, 9*b* and checking the weights of the products to remove any excessively heavy products which are not in accord with standards. The palletizing station 28 stacks a predetermined number of corrugated cardboard cases 24, each loaded with packed products 9*a*, 9*b*, on a pallet 186.

Operation of the automatic packaging apparatus 10 thus constructed will be described below with respect to the method of automatically packaging encased products according to the present invention.

As shown in FIG. 3, a number of encased products 5 are filled in the container 30. Encased products 5 are delivered from the container 30 to the feeder 32, which feeds the encased products 5 one by one to the inclined feed surface 36. The encased products 5 are supplied one by one to a space between the rollers 34*a*, 34*b* disposed over the inclined feed surface 36.

As shown in FIG. 4, the closest outer circumferential surfaces of the rollers 34*a*, 34*b* are spaced from each other by the distance H which is greater than the diameter of the film cases 3 of encased products 5 and smaller than the diameter of the case caps 4 thereof. The encased products 5 supplied between the rollers 34*a*, 34*b* are held in such an attitude or orientation that the case caps 4 are supported on the outer circumferential surfaces of the rollers 34*a*, 34*b*. The encased products 5 are forcibly arrayed to have their case caps 4 oriented in one direction, i.e., upwardly.

The motor 40 has been energized to rotate the drive gear 42 fixed to the drive shaft 40*a*, thus rotating the rollers 34*a*, 34*b* in different directions through the first and second gears 44, 46 and the belt and pulley means 48. Therefore, the encased products 5 with the case caps 4 supported on the outer circumferential surfaces of the rollers 34*a*, 34*b* are fed smoothly in the direction indicated by the arrow A toward the sorting station 18 (see FIG. 1).

In the sorting station 18, as shown in FIGS. 5 and 6, the rotary base 64 of the sorting device 60 is angularly moved to a certain angular position about the pivot shaft 62. If the abreast-arrayed shrink-packaged product 7*a* is to be obtained from encased products 5, then the sorting device 60 is turned into alignment with the first feed path 14, and delivers the encased products 5, one by one or a given number at a time, onto the first conveyor lines 52*a*, 52*b* of the first feed path 14.

Specifically, the encased products 5 with the case caps 4 oriented upwardly are fed down the guide channel 50 in the direction indicated by the arrow A, and introduced into the rotary base 64 of the sorting device 60. On the rotary base 64, the feed belts 74*a*, 74*b* have been moved in the circulatory path by the motor 66 through the belt and pulley means 70. The introduced encased products 5 are delivered to the first conveyor line 52*a* or 52*b* by the circulatory movement of the feed belts 74*a*, 74*b*.

As shown in FIG. 8, the encased products 5 delivered to the first conveyor line 52*a* are fed to the first delivery unit 80. In the first delivery unit 80, the case caps 4 of the delivered encased products 5 are supported by the wall surface of the groove 92 of the first screw 88 which has been rotated by the motor 84. The encased products 5 are fed toward the second delivery unit 82 with the case caps 4 oriented upwardly. At this time, the encased products 5 are spaced apart by the pitch P1 near the second screw 90 of the second delivery unit 82.

The encased products 5 delivered to the second conveyor line 52*b* are fed to the second screw 90 of the second delivery unit 82 that is disposed at the distal end of the first conveyor line 52*b*. The case caps 4 of the delivered encased products 5 are supported by the wall surface of the groove 94 of the second screw 90 on one side thereof, while the second screw 90 is being rotated by the motor 86.

The guides 96 are disposed on both sides of an upstream portion of the second screw 90. As shown in FIGS. 7 and 8, the encased products 5 are reversed 180° by the groove 94 of the second screw 90 and the guide grooves 98 of the guides 96, and fed to the other side of the second screw 90. The encased products 5 are then arrayed with their case caps 4 oriented downwardly and fed in the direction indicated by the arrow A. After the encased products 5 are spaced at the pitch P2 and then the pitch P3, they are arrayed alternately with the encased products 5 delivered from the first delivery unit 80, at the pitch P4, whereupon they are fed to the packaging station 20.

In the packaging station 20, five encased products 5 are horizontally directed across the direction in which they are fed (see FIG. 1). The encased products 5 in this attitude (first attitude) are sealed by the shrink sheet 6*a* in a three-sided pillow configuration, and the shrink sheet 6*a* is heat-shrunk in the heating tunnel.

The perforations 100*a* have been defined in the shrink sheet 6*a* by the cutting blade 106 of the cutter 102 (see FIG. 9) before the shrink sheet 6*a* packages the encased products 5. As shown in FIG. 10, the presser 116 is actuated to prevent the encased products 5 from moving, e.g., rolling, at the time they are sealed by the shrink sheet 6*a*. Specifically, the two round belts 124*a*, 124*b* of the presser 116 press the five encased products 5 to prevent the encased products 5 from rolling at the time they are sealed by the shrink sheet 6*a*.

The abreast-arrayed shrink-packaged product 7*a* thus produced is then delivered to the pillow packaging device 130 of the packing station 22. In the pillow packaging device 130, as shown in FIG. 11, the outer pack 8*a* is introduced into the former 134, and perforated to form the perforations 144*a* therein with the needles 152 of the roller 146 (see FIG. 13) that is located in the feed path of the outer pack 8*a*. Thereafter, the front and rear ends of the outer pack 8*a* are temporarily sealed in a three-sided pillow configuration.

As shown in FIG. 12, the heater 136 in the former 134 has the grooves 142*a*, 142*b* defined in the lower block 138 and the upper block 140. The grooves 142*a*, 142*b* produce unsealed regions in the front and rear areas of the outer pack 8*a* that is temporarily sealed, and air is removed from the outer pack 8*a* through the unsealed regions.

The packed product 9*a* which has been temporarily sealed by the pillow packaging device 130 is then sent to the tightening device 132. As shown in FIG. 14, the tightening device 132 tightens the outer pack 8*a* around the abreast-arrayed shrink-packaged product 7*a*, and finally seals (second seal) the outer pack 8*a*.

Specifically, the third seal region 170 as the shorter end of the outer pack 8*a* is sealed by being pressed and heated by the third heater block 172. On the longer hanger 160, the first seal region 162 of the abreast-arrayed shrink-packaged product 7*a* is sealed by being pressed and heated by the first heater block 164. Then, after elapse of a given period of time, the second seal region 166 positioned outwardly of the first seal region 162 is sealed by being pressed and heated by the second heater block 168. The outer pack 8*a* is then tightly wrapped around the abreast-arrayed shrink-packaged product 7*a*, thus reliably packing the abreast-arrayed shrink-packaged product 7*a*.

The finally sealed packed product 9*a* is then fed to the cooling device 180 (see FIG. 2), where the hanger 160 is cooled, and then trimmed by the blanking device 182. The packed product 9*a* is then fed to the corrugated case packing station 26, where a given number of packed products 9*a* are automatically or manually placed in the corrugated cardboard case 24. Thereafter, the filled corrugated cardboard case 24 is sent to the printing and weight checking station 184. After having been printed and checked for weight in the printing and weight checking station 184, the corrugated cardboard case 24 is delivered to the palletizing station 28, where a given number of filled corrugated cardboard cases 24 are stacked on the pallet 186.

If the tandem-arrayed shrink-packaged product 7*b* is to be obtained from encased products 5, the sorting device 60 is turned into alignment with the second feed path 16, and delivers the encased products 5 onto the second conveyor line 54 of the second feed path 16 (see FIGS. 5 and 6). On the second conveyor line 54, the encased products 5 are fed with the case caps 4 oriented upwardly, and knocked down backward in the feed direction by the knock-down member 99. The encased products 5 are then successively fed in this attitude (second attitude) (see FIG. 1).

The encased products 5 are fed in the second attitude to the packaging station 20. As with the abreast-arrayed shrink-packaged product 7*a*, three encased products 5 are shrink-packaged by the shrink sheet 6*b*, producing the tandem-arrayed shrink-packaged product 7*b*. The shrink sheet 6*b* has the perforations 100*b* already defined therein.

The tandem-arrayed shrink-packaged product 7*b* is then fed to the packing station 22, where the outer pack 8*b* is temporarily sealed (first seal) by the pillow packaging device 130 and then finally sealed (second seal) by the tightening device 132. In the final sealing process, as with the abreast-arrayed shrink-packaged product 7*a*, the outer pack 8*b* is tightened and sealed around the tandem-arrayed shrink-packaged product 7*b*, producing the packed product 9*b*. The packed product 9*b* is then cooled by the cooling device 180 and trimmed by the blanking device 182. Thereafter, the packed product 9*b* is fed successively to and processed by the corrugated case packing station 26, the printing and weight checking station 184, and the palletizing station 28 (see FIG. 2).

In the present embodiment, as described above, the encased products 5 are forcibly arrayed to orient the case caps 4 upwardly by the rollers 34*a*, 34*b*. Thereafter, in the sorting station 18, the encased products 5 are sorted selectively into the first and second feed paths 14, 16 depending on the packaged pattern, i.e., the abreast-arrayed shrink-packaged product 7*a* or the tandem-arrayed shrink-packaged product 7*b*.

In the first delivery unit 80 of the first feed path 14, the encased products 5 are fed with the case caps 4 oriented upwardly. In the second delivery unit 82 of the first feed path 14, the encased products are reversed 180° to direct the case caps 4 downwardly, after which they are arranged alternately, one by one, with the encased products 5 delivered from the first delivery unit 80 (first attitude).

In the second feed path 16, the encased products 5 are fed with the case caps 4 oriented upwardly by the second conveyor line 54. While the encased products 5 are being thus fed, they are knocked down backward in the feed direction by the knock-down member 99, and delivered to the packaging station 20 in this attitude (second attitude).

In the packaging station 20, the encased products 5 is delivered as they are automatically arrayed into the first attitude, i.e., the abreast-arrayed pattern, and the second attitude, i.e., the tandem-arrayed pattern, for automatically packaging the abreast-arrayed shrink-packaged product 7*a* and the tandem-arrayed shrink-packaged product 7*b*. Therefore, the entire packaging operation is performed easily automatically and efficiently as compared with the conventional process of only automatically packaging the abreast-arrayed shrink-packaged product 7*a* and the conventional process of manually packaging the tandem-arrayed shrink-packaged product 7*b*. Since the abreast-arrayed shrink-packaged product 7*a* and the tandem-arrayed shrink-packaged product 7*b* are selectively and automatically packaged by the single automatic packaging apparatus 10, the overall facility required is smaller in size and more economical than if dedicated machines are used to package the abreast-arrayed shrink-packaged product 7*a* and the tandem-arrayed shrink-packaged product 7*b*, respectively.

When encased products 5 are to be arrayed abreast, the case caps 4 of adjacent encased products 5 are oriented in different directions. Therefore, if a certain number of, e.g., five, encased products 5 are to be arrayed abreast, the overall encased products 5 are kept in a stable shape, allowing the abreast-arrayed shrink-packaged product 7*a* to be shrink-packaged smoothly and reliably. Since the five encased products 5 are pressed and held by the two round belts 124*a*, 124*b* of the presser 116, the abreast-arrayed shrink-packaged product 7*a* can be shrink-packaged reliably.

As shown in FIG. 14, for packing the abreast-arrayed shrink-packaged product 7*a* with the outer pack 8*a*, the first seal region 162*a* of the hanger 160 closer to the abreast-arrayed shrink-packaged product 7*a* is sealed by the first heater block 164, and, after elapse of a certain period of time, the second seal region 166 positioned outwardly of the first seal region 162 is sealed by the second heater block 168. Thus, the outer pack 8*a* is tightened and finally sealed over the abreast-arrayed shrink-packaged product 7*a*. The packed product 9*a* can be made compact with the abreast-arrayed shrink-packaged product 7*a* firmly held in position in the outer pack 8*a* against wobbling movement.

The first feed path 14 for arraying the encased products 5 to package them in the first attitude has the first and second screws 88, 90, and the guides 96 for reversing the encasing products 5 by 180° are combined with the second screw 90. Therefore, the entire structure of the first feed path 14 is effectively simplified, allowing the encased products 5 oriented alternately in opposite directions to be arrayed reliably in the second attitude with an inexpensive arrangement.

In the present embodiment, the abreast-arrayed shrink-packaged product 7*a* is made up of five encased products 5. However, the abreast-arrayed shrink-packaged product 7*a* may be made up of two through five encased products 5. The tandem-arrayed shrink-packaged product 7*b* may be made up of two encased products 5.

In the method of and the apparatus for automatically packaging encased products, the encased products are selectively sorted into the first feed path or the second feed path depending on the packaging pattern, and thereafter the encased products are arrayed in the first attitude or the second attitude and automatically packaged by the packaging sheet. Therefore, the encased products can selectively and automatically be packaged in the different first and second attitudes, e.g., the abreast-arrayed pattern and the tandem-arrayed pattern. The overall packaging process is easily made efficient, and the facility required to perform the packaging process is reduced in size and made economical.

Although a certain preferred embodiment of the present invention has been shown and described in detail, it should be understood that various changes and modifications may be made therein without departing from the scope of the appended claims.

What is claimed is:

1. A method of automatically packaging a plurality of encased products, each comprising a product sealed in a case barrel and a cap mounted on the case barrel, in a packaging sheet, comprising the steps of:

forcibly arraying said encased products to orient said caps in one direction;

selectively sorting the arrayed encased products to a first feed path for arraying the encased products to package the encased products in a first attitude and a second feed path for arraying the encased products to package the encased products in a second attitude different from said first attitude; and packaging a given number of said encased products arrayed in said first attitude by said first feed path or said encased products arrayed in said second attitude by said second feed path, with said packaging sheet.

2. A method according to claim 1, wherein said first attitude is an attitude to array said encased products 5 abreast, and a first group of said encased products 5 are arrayed on said first feed path with the caps oriented upwardly and a second group of said encased products 5 are arrayed on said first feed path with the caps oriented downwardly, and the first and second groups of said encased products 5 are alternately discharged from said first feed path.

3. A method according to claim 2, further comprising the steps of:

arraying and feeding the encased products discharged in said first attitude; and holding said encased products together by a presser, and packaging the encased products with said packaging sheet.

4. A method according to claim 1, wherein said second attitude is an attitude to array said encased products 5 tandem, and said encased products are knocked down to orient said caps in one direction on said second feed path and then successively discharged from said second feed path.

5. A method according to claim 1, further comprising the steps of:

supplying a sheet-like outer pack to the encased products packaged by said packaging sheet, forming perforations in the outer pack, packing the encased products with the outer pack, and applying a first seal to front and rear ends of said outer pack in front of and behind said encased products; and tightening said outer pack with said first seal applied thereto, removing air from the outer pack through said perforations and an unsealed region in said first seal, and thereafter applying a second seal to said outer pack.

6. A method according to claim 5, wherein said first seal is formed as a first seal region on a portion of said outer pack near said encased products, and said second seal is formed as a second seal region wider than and overlapping said first seal region of said outer pack.

7. A method according to claim 5, wherein tightening of said outer pack is performed by a tightening device which contains at least one heater for sealing a region, and further wherein when tightening of said outer pack is performed by a tightening device air is forced out through said perforations.

* * * * *